US011050169B2

(12) United States Patent
Shan

(10) Patent No.: US 11,050,169 B2
(45) Date of Patent: Jun. 29, 2021

(54) WIRING TERMINAL AND CORRESPONDING ELECTRICAL COMPONENT

(71) Applicant: Schneider Electric (Australia) Pty Ltd, Macquarie Park (AU)

(72) Inventor: Fuhua Shan, Shanghai (CN)

(73) Assignee: SCHNEIDER ELECTRIC (AUSTRALIA) PTY LTD, Macquarie Park (AU)

( * ) Notice: Subject to any disclaimer, the term of this patent is extended or adjusted under 35 U.S.C. 154(b) by 0 days.

(21) Appl. No.: 16/519,357

(22) Filed: Jul. 23, 2019

(65) Prior Publication Data

US 2020/0036112 A1 Jan. 30, 2020

(30) Foreign Application Priority Data

Jul. 25, 2018 (CN) ..... 201821190696.9

(51) Int. Cl.
*H01R 4/48* (2006.01)
*H01R 4/42* (2006.01)

(52) U.S. Cl.
CPC ..... *H01R 4/42* (2013.01)

(58) Field of Classification Search
CPC ..... H01R 4/4845; H01R 9/24; H01R 9/26
USPC ..... 439/835, 709, 716
See application file for complete search history.

(56) References Cited

U.S. PATENT DOCUMENTS 3,010,347 A * 11/1961 Saul Kron ..... B25B 13/12 81/176.15
4,519,668 A 5/1985 Fujita et al.
4,944,700 A 7/1990 Simon
6,010,347 A 1/2000 Lee
7,048,591 B1 * 5/2006 Chiang ..... H01R 4/363 439/709

(Continued)

FOREIGN PATENT DOCUMENTS

CN 102723195 A 10/2012
CN 106207506 A 12/2016

(Continued)

OTHER PUBLICATIONS

United Kingdom Combined Search and Examination Report dated Jan. 17, 2020 for the corresponding GB Application No. 1910145.0 (11 pages).

(Continued)

*Primary Examiner* — Phuong Chi Thi Nguyen
(74) *Attorney, Agent, or Firm* — Locke Lord LLP

(57) ABSTRACT

Embodiments of the present disclosure relate to a terminal and a corresponding electrical component. The terminal comprises a U-shape connector comprising a first part and a second part opposite to each other, and a third part connecting the first part and the second part; a threaded terminal formed on a first surface of the first part and being integral with the first part; and an unthreaded terminal coupled to a second surface of the first part of the connector, the second surface being opposite to the first surface, and the unthreaded terminal being electrically coupled to the threaded terminal. According to embodiments of the present disclosure, actual needs of different customers can be satisfied and the reliability of the terminal can also be enhanced.

10 Claims, 5 Drawing Sheets

(56) References Cited

U.S. PATENT DOCUMENTS

| | | | | |
|---|---|---|---|---|
| 7,445,519 | B2 * | 11/2008 | Matsumoto | H05K 7/1432<br>257/690 |
| 7,473,146 | B2 * | 1/2009 | Fuzetti | H01R 4/36<br>439/717 |

FOREIGN PATENT DOCUMENTS

| | | | |
|---|---|---|---|
| CN | 207800938 | U | 8/2018 |
| DE | 19934550 | A1 | 2/2001 |
| DE | 10253486 | A1 | 5/2004 |
| GB | 918316 | A | 2/1963 |
| JP | 54-53285 | A | 4/1979 |
| JP | 2009-259537 | A | 11/2009 |
| JP | 2015-46245 | A | 3/2015 |

OTHER PUBLICATIONS

United Kingdom Examination Report dated Nov. 2, 2020 for the corresponding GB Application No. 1910145.0 (3 pages).

* cited by examiner

WIRING TERMINAL AND CORRESPONDING ELECTRICAL COMPONENT

FIELD

Embodiments of the present disclosure relate to a wiring terminal and a corresponding electrical component.

BACKGROUND

In the electrical components, the electric wires are usually connected and secured by terminals. When the electric wires are being connected to the terminals, the metal conductor inside the electric wires has been exposed. The terminals are connected to the exposed metal conductor to establish a conductive connection between the terminals and the electric wires. Existing electric wires conventionally have two types, i.e., single-core hard conductor and multi-core soft conductors and the terminals of the existing electrical components usually include threaded and unthreaded terminals. The threaded terminals are mainly applied to connect with both the multi-core soft conductors and the single-core hard conductor, whereas the unthreaded terminal is only adapted to connect with the single-core hard conductor. Since the standards and specifications of terminals of electrical components vary in different countries and regions, in order to adapt to the various standards and specifications, it is required to configure corresponding types of terminals in the electrical components.

SUMMARY

The known electrical components generally adopt only one of the above two types of terminals, which limit the application range thereof. Besides, the threaded terminal and the connector in the wiring terminal are usually fabricated separately and then connected together through a plurality of connecting process such as soldering. Such design incurs errors in fabrication and assembly and thus reduces reliability of the terminal, especially in the scenario where the terminal is used repeatedly.

Embodiments of the present disclosure provide a wiring terminal and an electrical component comprising the wiring terminal and are intended to at least partially address the above and/or other potential problems in the design of the terminals.

In a first aspect, embodiments of the present disclosure provide a wiring terminal. The wiring terminal comprises a U-shape connector comprising a first part and a second part opposite to each other, and a third part connecting the first part and the second part; a threaded terminal formed on a first surface of the first part and being integral with the first part; and an unthreaded terminal coupled to a second surface of the first part of the connector, the second surface being opposite to the first surface, and the unthreaded terminal being electrically coupled to the threaded terminal.

According to embodiments of the present disclosure, by incorporating both threaded and unthreaded terminals into the same terminal, the advantages of both the terminals are combined accordingly. This design can satisfy the actual needs of different customers at the same time. Meanwhile, by making the threaded terminal and the connector to be integrated, the multiple connections and thus the errors of multi factors in fabrication and assembly can be reduced. In this way, the electrical connecting performance of the wiring terminal can be improved and reliability of the wiring terminal can be increased as well.

In some embodiments, the threaded terminal comprises: a wire cavity comprising an opening formed on one end thereof for a conducting wire to be inserted; a threaded hole formed on a side wall surrounding the opening and proximate to the first part; and a screw passing through the threaded hole and being adapted to press the conducting wire. In this way, the secure wiring of the threaded terminal can be achieved.

In some embodiments, the connector comprises a hole formed on the first part; and the unthreaded terminal comprises a U-shape bracket comprising a top part and a bottom part opposite to each other; and wherein each of the top part and the bottom part comprises an elongation, the elongation comprising a hook inserted into the hole of the first part. In this way, the bracket can be securely coupled to the connector to enhance firmness of wiring of the unthreaded terminal.

In some embodiments, the bracket further comprises a lateral part connecting the top part and the bottom part, and a lug is formed on the lateral part.

In some embodiments, the unthreaded terminal further comprises: an elastic piece comprising a base being pressed against the lateral part of the bracket by the lug. In this way, the elastic piece is firmly coupled to the bracket to further increase the reliability of the unthreaded terminal.

In some embodiments, the elastic piece further comprises: a first extension and a second extension respectively extending from two ends of the base, the first extension and the second extension being capable of abutting the first part of the connector under an elastic force of the elastic piece. In this way, the firmness of the elastic piece can be enhanced.

In some embodiments, the first part comprises a groove, the groove adapted for the conducting wire to be inserted and allowing the conducting wire to be held in the groove by the first extension and the second extension of the elastic piece. In this way, the fastness of the connection between the conducting wire and the unthreaded terminal can be increased.

In some embodiments, the connector comprises a release hole disposed on the first part, the release hole being adapted to release the conducting wire from the unthreaded terminal in response to an external force pushing the elastic piece away from the first part through the release hole when the conducting wire is inserted into the unthreaded terminal. In this way, the conducting wire can be detached from the unthreaded terminal conveniently.

In some embodiments, the wiring terminal further comprises: a locating hole positioned on the third part of the connector, the locating hole being adapted to be sleeved into a locating column of a mounting body to secure the wiring terminal to the mounting body. In this way, the wiring terminal can be coupled to an expected mounting body, so as to expand the adaptable range of the wiring terminal.

In a second aspect, embodiments of the present disclosure provide an electrical component comprising the wiring terminal of the first aspect. In this way, the electrical component can satisfy actual needs of different customers at the same time and enhance the reliability of the electrical components.

In some embodiments, the electrical component is a switch or a socket. In this way, the switch or the socket can satisfy actual needs of different customers at the same time and the stability and reliability of the switch or the socket can be enhanced.

BRIEF DESCRIPTION OF THE DRAWINGS

Through the following detailed description with reference to the accompanying drawings, the above and other objectives, features, and advantages of embodiments of the present disclosure will be more apparent. In the drawings, a plurality of embodiments of the present disclosure are explained in an exemplary and non-restrictive manner, wherein.

DETAILED DESCRIPTION OF EMBODIMENTS

Figure 1:
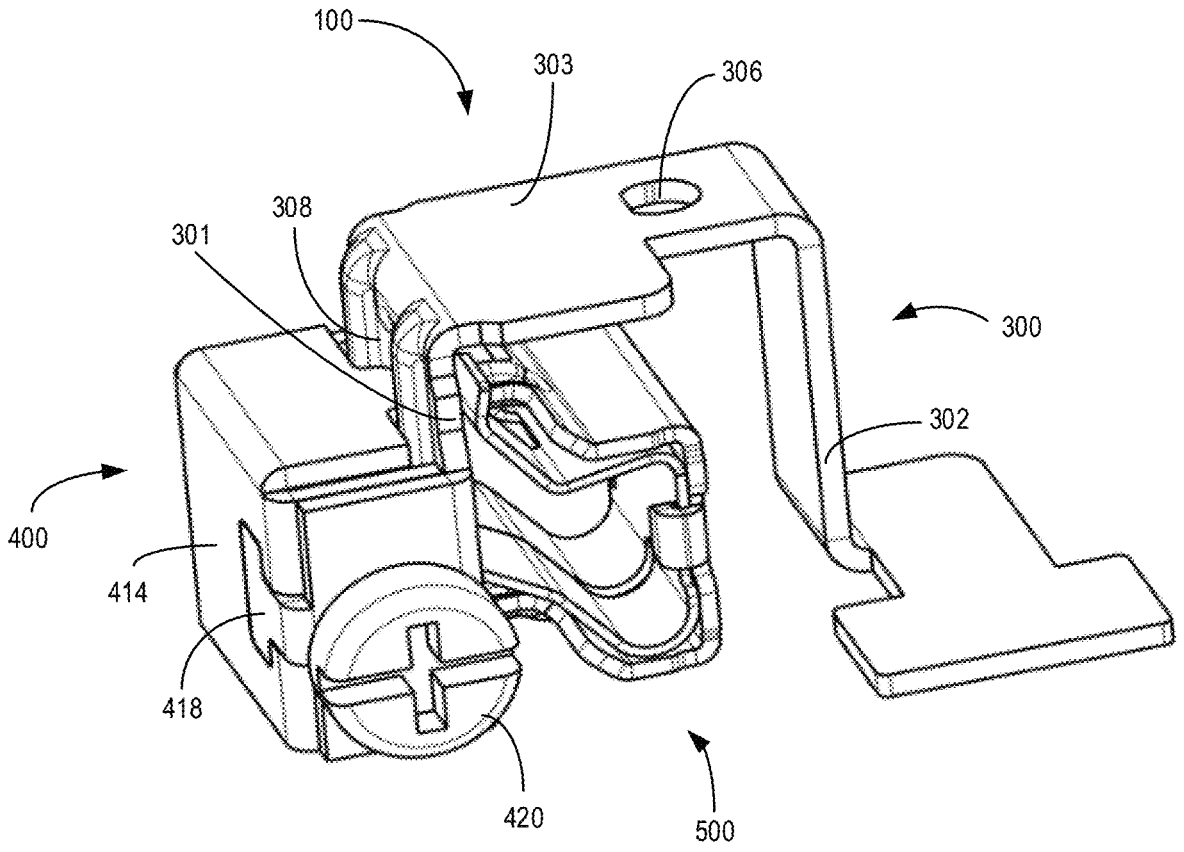
FIG. 1 illustrates a perspective view of a terminal in accordance with embodiments of the present disclosure.

Principles of the present disclosure are now explained with reference to various example embodiments illustrated in the drawings. It should be appreciated that description of those embodiments is merely to enable those skilled in the art to better understand and further implement the present disclosure and is not intended to limit the scope disclosed herein in any manner. It should be noted similar or same reference signs can be used in the drawings where feasible, and similar or same reference signs may represent similar or same functions. Those skilled in the art will easily understand from the following description that alternative embodiments of the structure and method explained herein can be adopted without departing from the principles of the present invention described herein.

As mentioned above, existing electrical components often intends to use either threaded terminals or unthreaded terminals only. However, it may be required to choose between threaded terminals and unthreaded terminals during actual use based on the practical needs of customers. Therefore, the electrical components with a single type of threaded terminal are restricted during promotion.

Figure 2:
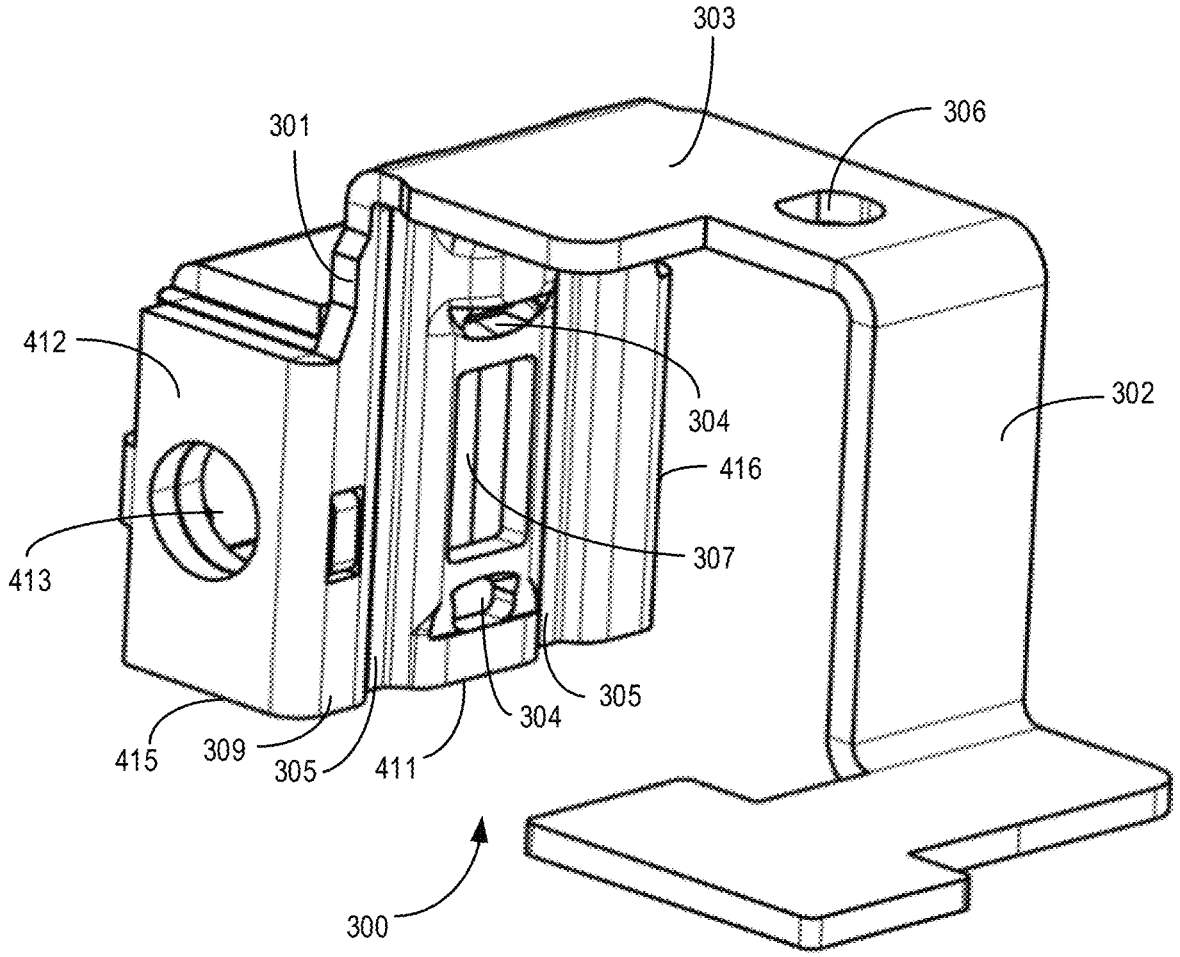
FIG. 2 illustrates a further perspective view of the terminal in accordance with embodiments of the present disclosure, wherein unthreaded terminal is omitted.

Some example embodiments are described now with reference to FIGS. 1 to 2. FIG. 1 illustrates a perspective view of a wiring terminal 100 in accordance with embodiments of the present disclosure. FIG. 2 illustrates a further perspective view of the wiring terminal 100 in accordance with embodiments of the present disclosure wherein the unthreaded terminal is omitted for the sake of clarity.

As illustrated in FIG. 1, embodiments of the present disclosure provide a wiring terminal 100, which generally includes a connector 300, a threaded terminal 400 and an unthreaded terminal 500. The connector 300 is generally of a U shape and can be formed by a first part 301, a second part 302 and a third part 303. The first part 301 and the second part 302 are disposed opposite to each other and are connected by the third part 303.

As illustrated in FIG. 2, the threaded terminal 400 is formed on a first surface 308 of the first part 301 of the connector 300. The threaded terminal 400 is integrally formed with the connector 300. The threaded terminal 400 and the connector 300 may be fabricated integrally through molding characteristics of a copper piece. It is to be understood that the threaded terminal 400 and the connector 300 may also be fabricated integrally through other metals in addition to copper. The specific material is not restricted by embodiments of the present disclosure.

As illustrated in FIG. 1, the unthreaded terminal 500 is coupled to a second surface 309 of the first part 301 of the connector 300, the second surface 309 be opposite to the first surface 308. The unthreaded terminal 500 is electrically coupled to the threaded terminal 400. In the embodiment shown by FIG. 1, the threaded terminal 400 and the unthreaded terminal 500 are arranged side by side. It is to be appreciated that the unthreaded terminal 500 and the threaded terminal 400 can be arranged in other manners according to the specific using environment. For example, the unthreaded terminal 500 in FIG. 1 may be rotated clockwise by 90 degrees to connect with the first part 301, the second part 302 and the third part 303, such that the threaded terminal 400 and the unthreaded terminal 500 are arranged at two sides.

In accordance with embodiments of the present disclosure, the wiring terminal 100 includes the threaded terminal 400 and the unthreaded terminal 500. In this way, the wiring terminal 100 can satisfy the needs of the customers using both the unthreaded terminals and the threaded terminals, which further improves wiring capability of the wiring terminal 100 and expands its adaptable range. Meanwhile, by making the threaded terminal 400 and the connector 300 to be integrally fabricated, multiple connections and many factor errors in manufacturing and assembly can be reduced, such that the product gains a more satisfactory electrical connection performance and becomes more stable and reliable.

Figure 3:
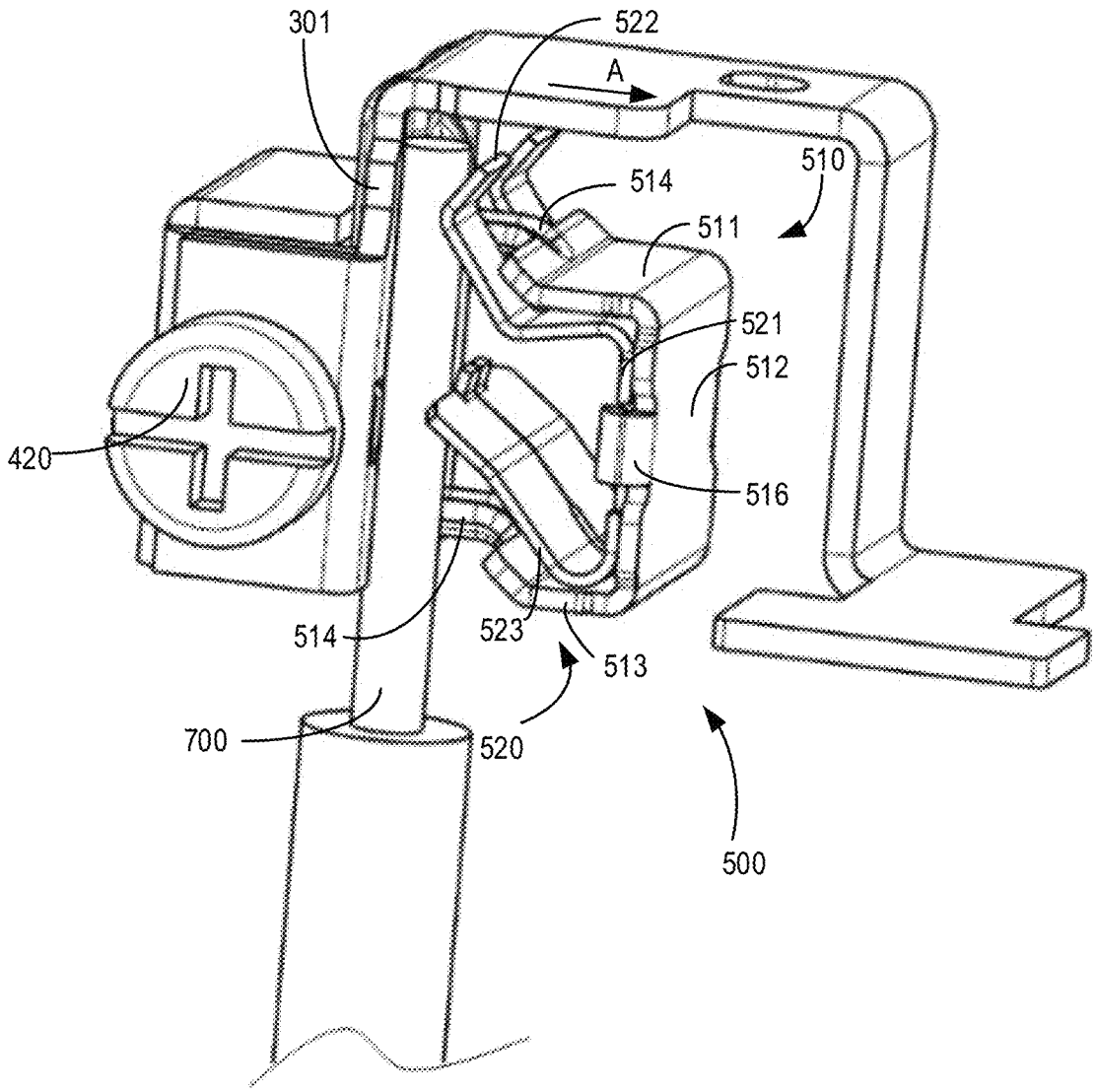
FIG. 3 illustrates another perspective view of the terminal in accordance with embodiments of the present disclosure.

Some example implementations of the wiring terminal 100 are described hereinafter with reference to FIGS. 3 and 4. FIG. 3 illustrates another perspective view of the wiring terminal 100 in accordance with embodiments of the present disclosure and FIG. 4 illustrates a bottom perspective view of the wiring terminal 100 in accordance with embodiments of the present disclosure.

In some embodiments, the threaded terminal 400 may include a wire cavity 410. As illustrated in FIGS. 3 and 4, the wire cavity 410 is formed on its one end 415 with an opening 411. The opening 411 is dimensioned and shaped to allow users using the threaded terminal 400 to insert a conducting wire. The threaded terminal 400 may also include a threaded hole 413, which is disposed on a side wall 412 partially surrounding the opening 411 and being proximate to the first part 301. The threaded terminal 410 may also include a screw 420, which passes through the threaded hole 413 and presses against the conducting wire along screwing of the screw 420 when the conducting wire is inserted into the wire cavity 410. In this way, the fastness of the wiring of the threaded terminal 400 can be effectively guaranteed.

Figure 4:
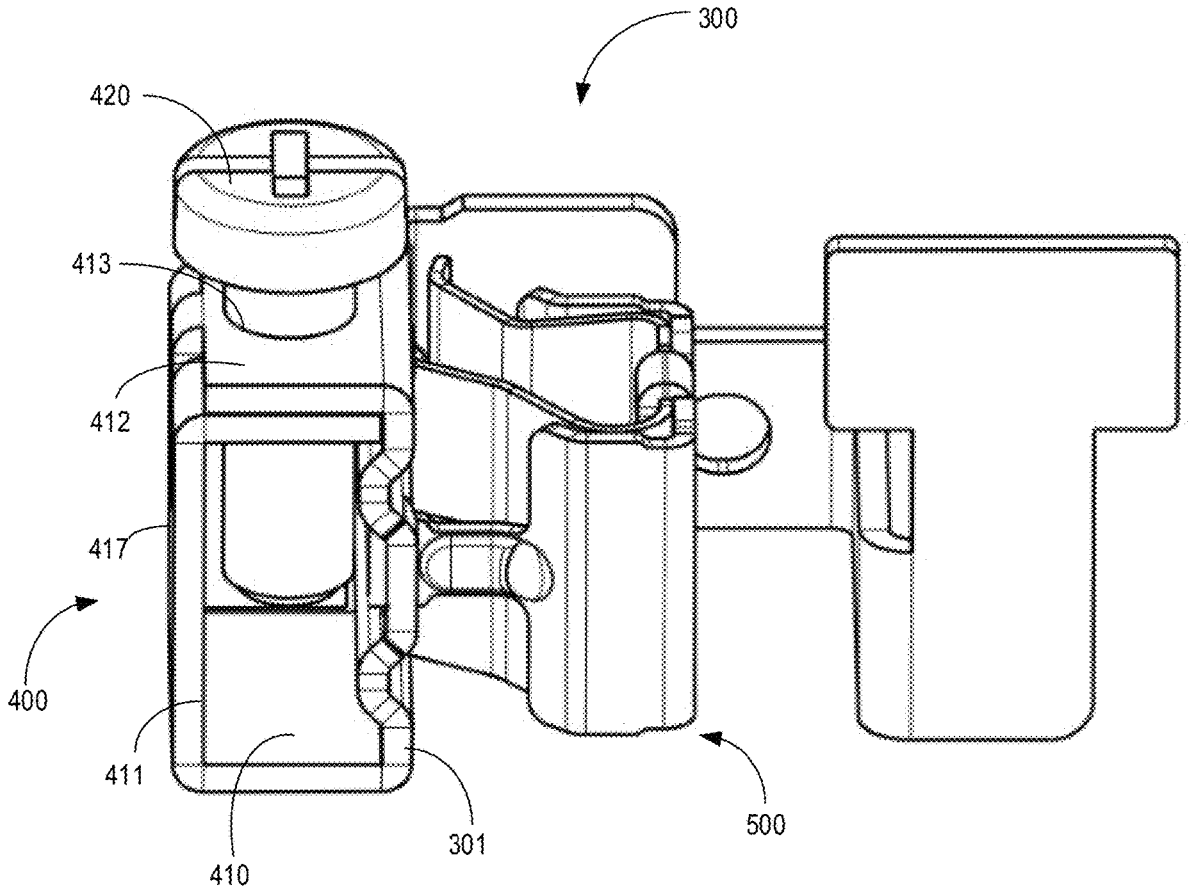
FIG. 4 illustrates an upward-view perspective view of the terminal in accordance with embodiments of the present disclosure.

As shown in FIG. 4, in some embodiments, the wire cavity 410 may substantially be cuboid and the opening 411 is positioned at the bottom of the wire cavity 410. It should be understood that this is only exemplary and the wire cavity 410 may have other shapes in addition to cuboid in other embodiments, as long as the cavity 410 can be formed to accommodate the conducting wire. The opening 411 may also be set in different orientations and/or positions, such that the conducting wire can be inserted into the wire cavity 410 from different directions based on the actual requirements.

Moreover, in alternative embodiments, the screw 420 and the threaded hole 413 can be configured on other side walls of the wire cavity 410 as long as the specific configuration would not interfere the usage of other components. For example, the threaded hole 413 can be arranged on a side wall 416 opposite to the side wall 412 shown in FIG. 4 or on a side wall 417 next to the side wall 412. The position and screwing direction of the screw 413 are adjusted accordingly.

In some embodiments, as illustrated in FIG. 3, the connector 300 may have a hole 304 formed on the first part 301. The unthreaded terminal 500 may include an elastic piece 520 and a U-shaped bracket 510 mated therewith. The bracket 510 may have a top part 511 and a bottom part 513 opposing to each other, and a lateral part 512 connecting the top part 511 and the bottom part 513.

As shown, the top part 511 and the bottom part 513 may have respective elongations 514. The end of each of the elongations 514 has a hook 515 adapted to insert into a respective hole 304 of the connector 300. Accordingly, the bracket 510 can be firmly coupled to the connector 300, thereby achieving stable wiring of the unthreaded terminal 500.

In some embodiments, a lug 516 is formed on the lateral part 512 of the bracket 510. As illustrated in FIG. 3, the bracket 510 has two lugs 516. It is to be appreciated that other numbers of lugs may also be disposed on the lateral part 512.

The unthreaded terminal 500 may also include an elastic piece 520 for use with the bracket 510. The elastic piece 520 can be at least partially made of an elastic material. The elastic piece 520 may also include a base 521, which is "hugged" by the lug 516 and is then pressed against the lateral part 512 of the bracket 510. In this way, the elastic piece 520 is firmly coupled to the bracket 510, which further increases the wiring reliability of the unthreaded terminal 500.

In some embodiments, the elastic piece 520 may also include a first extension 522 and a second extension 523 extending from the base 521, wherein both the extensions 522, 523 may be at least partially made of elastic materials. Since the base 521 of the elastic piece 520 is held on the lateral part 512 of the bracket 510 by the lug 516 of the bracket 510, the first extension 522 and the second extension 523 abut the second surface 309 of the first part 301 of the connector 300 under the action of the elastic material of the elastic piece 520. Therefore, the firmness of the elastic piece 520 is increased.

In some embodiments, the connector 300 is provided on its first part 301 with a groove 305 and the groove 305 may have a circular cross section. When being inserted along the groove 305, the conducting wire 700 pushes the first extension 522 and the second extension 523 of the elastic piece 520 away and is then compressed between the first extension 522 and the second extension 523 of the elastic piece 520 and the first part 301 of the connector 300 under the elastic force of the elastic piece 520. Therefore, a firm wiring between the conducting wire 700 and the unthreaded terminal 500 can be ensured.

In some embodiments, as illustrated in FIG. 2, the connector 300 may further include a release hole 307 on the first part 301. When it is required to release the conducting wire 700 from the unthreaded terminal 500, an external force may be applied via the release hole 307 onto the first extension 522 and the second extension 523 of the elastic piece 520. Accordingly, the elastic piece 520 can be moved away from the first part 301 of the connector 300 along a direction A as shown in FIG. 3, such that the conducting wire 700 is released from the unthreaded terminal 500. The external force may be applied by means of a tool like screwdriver. The tool may enter through an inlet 418 on the side wall 414 of the threaded terminal 400 and then pass through the release hole 307, so as to release the conducting wire 700. With the arrangement of the release hole 307, when users intend to replace or disassemble the conducting wire 700, the conducting wire 700 can be conveniently released from the unthreaded terminal 500.

In some embodiments, the wiring terminal 100 may also include a locating hole 306, which may be coupled with a locating column on a mounting body. For example, the locating hole 306 may be sleeved into the locating column of the mounting body, so as to locate the wiring terminal 100 on the mounting body. In this way, the users can couple the wiring terminal 100 to an intended position as required, which can greatly increase the application range of the wiring terminal 100.

Figure 5:
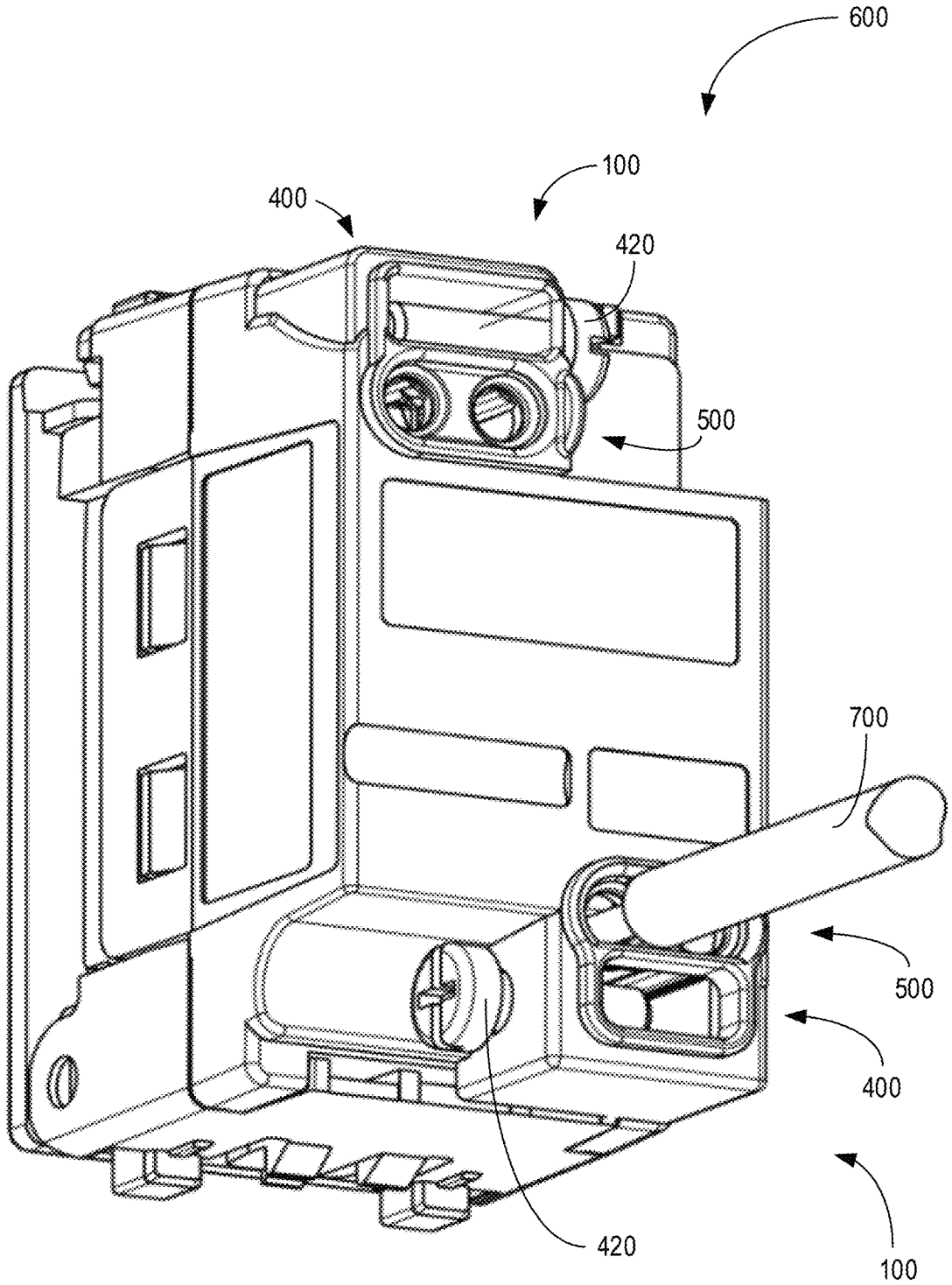
FIG. 5 illustrates a perspective view of the electrical component having the terminal in accordance with embodiments of the present disclosure.

An electrical component 600 using the above described wiring terminal 100 is described hereinafter with reference to FIG. 5. FIG. 5 illustrates a perspective view of the electrical component 600 having the wiring terminal 100 in accordance with embodiments of the present disclosure. The electrical component 600 comprises the above described wiring terminal 100. The electrical component 600 including the above wiring terminal 100 can satisfy the actual needs of various customers and also improve the reliability.

In some embodiments, the electrical component 600 may be a switch or a socket. In some embodiments, the electrical component 600 may also be other electrical components adapted to use the wiring terminal 100. As shown in FIG. 5, the electrical component 600 comprises two terminals 100. It is to be understood that other numbers of terminals 100 may also be used according to the actual requirements. For example, the electrical component 600 may comprise only one wiring terminal 100 or alternatively comprise three or four or even more terminals 100.

Although the claims of the present application are made for certain combinations of the features, it should be appreciated that the scope of the present disclosure also includes any explicitly or implicitly summarized novel features or novel combinations of the features no matter whether or not the features relate to the same solutions in any claims sought for protection.

I claim:

1. A wiring terminal comprising:

a U-shape connector comprising a first part and a second part opposite to each other, and a third part connecting the first part and the second part;

a threaded terminal formed on a first surface of the first part and being integral with the first part;

an unthreaded terminal coupled to a second surface of the first part of the connector, the second surface being opposite to the first surface, and the unthreaded terminal being electrically coupled to the threaded terminal; and the connector comprises a hole formed on the first part; and the unthreaded terminal comprises a U-shape bracket comprising a top part and a bottom part opposite to each other; and wherein each of the top part and the bottom part comprises an elongation, the elongation comprising a hook inserted into the hole of the first part.

2. The wiring terminal of claim 1, wherein the threaded terminal comprises:

a wire cavity comprising an opening formed on one end thereof for a conducting wire to be inserted;

a threaded hole formed on a side wall surrounding the opening and being proximate to the first part; and a screw passing through the threaded hole and adapted to press the conducting wire.

3. The wiring terminal of claim 1, further comprising:

a locating hole positioned on the third part of the connector, the locating hole being adapted to be sleeved into a locating column of a mounting body to secure the wiring terminal to the mounting body.

4. The wiring terminal of claim 1, wherein the bracket further comprises a lateral part connecting the top part and the bottom part), and a lug is formed on the lateral part.

5. The wiring terminal of claim 4, wherein the unthreaded terminal further comprises:

an elastic piece comprising a base being pressed against the lateral part of the bracket by the lug.

6. The wiring terminal of claim 5, wherein the connector comprises a release hole disposed on the first part, the release hole being adapted to release the conducting wire from the unthreaded terminal in response to an external force pushing the elastic piece away from the first part through the release hole when the conducting wire is inserted into the unthreaded terminal.

7. The wiring terminal of claim 5, wherein the elastic piece further comprises:

a first extension and a second extension respectively extending from two ends of the base, the first extension and the second extension being capable of abutting the first part of the connector under an elastic force of the elastic piece.

8. The wiring terminal of claim 7, wherein the first part comprises a groove adapted for the conducting wire to be inserted and allowing the conducting wire to be held in the groove by the first extension and the second extension of the elastic piece.

9. An electrical component comprising the a wiring terminal, wherein the wiring terminal comprises:

a U-shape connector comprising a first part and a second part opposite to each other, and a third part connecting the first part and the second part;

a threaded terminal formed on a first surface of the first part and being integral with the first part;

an unthreaded terminal coupled to a second surface of the first part of the connector, the second surface being opposite to the first surface, and the unthreaded terminal being electrically coupled to the threaded terminal; and the connector comprises a hole formed on the first part; and the unthreaded terminal comprises a U-shape bracket comprising a top part and a bottom part opposite to each other; and wherein each of the top part and the bottom part comprises an elongation, the elongation comprising a hook inserted into the hole of the first part.

10. The electrical component of claim 9, wherein the electrical component is a switch or a socket.

* * * * *